US011660665B2

(12) United States Patent
Bilski et al.

(10) Patent No.: US 11,660,665 B2
(45) Date of Patent: May 30, 2023

(54) ROLLER STAND HAVING ELASTICALLY MOUNTED SUPPORTING ROLLERS

(71) Applicant: Primetals Technologies Austria GmbH, Linz (AT)

(72) Inventors: Lukasz Bilski, Leonding (AT); Enrico Mayer, Niederwoelz (AT)

(73) Assignee: PRIMETALS TECHNOLOGIES AUSTRIA GMBH, Linz (AT)

( * ) Notice: Subject to any disclaimer, the term of this patent is extended or adjusted under 35 U.S.C. 154(b) by 0 days.

(21) Appl. No.: 17/270,745

(22) PCT Filed: Sep. 18, 2019

(86) PCT No.: PCT/EP2019/074940

§ 371 (c)(1),
(2) Date: Feb. 23, 2021

(87) PCT Pub. No.: WO2020/064448

PCT Pub. Date: Apr. 2, 2020

(65) Prior Publication Data

US 2021/0187599 A1 Jun. 24, 2021

(30) Foreign Application Priority Data

Sep. 25, 2018 (AT) ..... A50822/2018

(51) Int. Cl.

| | |
|---|---|
| ***B22D 11/128*** | (2006.01) |
| ***B22D 11/12*** | (2006.01) |
| ***B22D 11/20*** | (2006.01) |
| ***B22D 11/22*** | (2006.01) |

(52) U.S. Cl.
CPC ..... *B22D 11/1282* (2013.01); *B22D 11/1206* (2013.01); *B22D 11/1226* (2013.01);
(Continued)

(58) Field of Classification Search
CPC . B22D 11/12; B22D 11/1206; B22D 11/1226; B22D 11/128; B22D 11/1282;
(Continued)

(56) References Cited

U.S. PATENT DOCUMENTS 2,770,021 A * 11/1956 Harter, Jr. et al. ... B22D 11/141 164/454
6,332,492 B1 12/2001 Donini et al.
(Continued)

FOREIGN PATENT DOCUMENTS

CN 1278751 A 1/2001
CN 101614529 A 12/2009
(Continued)

OTHER PUBLICATIONS

International Search Report and Written Opinion received in International Application No. PCT/EP2019/074940 dated Nov. 13, 2019, pp. 14.
(Continued)

*Primary Examiner* — Kevin P Kerns
(74) *Attorney, Agent, or Firm* — Lang & Hennessey LLP; Brian Hennessey

(57) ABSTRACT

A roller stand for a continuous billet casting machine, having a carrying frame for mounting at least one lower supporting roller and at least two lateral supporting rollers. The lateral supporting rollers are mounted elastically on the carrying frame by means of at least one passive elastic element, and have an amount of elasticity at least in a direction perpendicular to the axes of rotation of the lateral supporting rollers. A method for determining the position and/or the shape of a billet is provided. During passage through at least one roller stand, alterations in the position at least of the lateral supporting rollers relative to a reference are detected and, on the basis of this information, the shape of the billet and/or the position of the billet in relation to the center line of the billet-guide channel are/is determined.

17 Claims, 8 Drawing Sheets

(52) U.S. Cl.
CPC ..... *B22D 11/1285* (2013.01); *B22D 11/1287* (2013.01); *B22D 11/208* (2013.01); *B22D 11/225* (2013.01)

(58) Field of Classification Search
CPC . B22D 11/1285; B22D 11/1287; B22D 11/20; B22D 11/208; B22D 11/22; B22D 11/225
USPC ..... 164/442, 448
See application file for complete search history.

(56) References Cited

U.S. PATENT DOCUMENTS

| | | | | |
|---|---|---|---|---|
| 9,630,247 | B2 * | 4/2017 | Dratva | F16C 17/02 |
| 2002/0005266 | A1 * | 1/2002 | Pleschiutschnigg et al. | B22D 11/128 164/442 |
| 2015/0183027 | A1 | 7/2015 | Dratva | |
| 2019/0039123 | A1 | 2/2019 | Imai et al. | |

FOREIGN PATENT DOCUMENTS

| | | | |
|---|---|---|---|
| CN | 104640650 | A | 5/2015 |
| CN | 211915426 | U | 11/2020 |
| DE | 1458132 | A1 | 1/1969 |
| DE | 1483548 | B1 | 12/1970 |
| DE | 2939321 | A1 | 4/1981 |
| EP | 1897636 | A1 | 3/2008 |
| EP | 2687303 | A1 | 1/2014 |
| GB | 1154587 | A | 6/1969 |
| JP | S61143740 | U | 9/1986 |
| JP | H05104220 | A | 4/1993 |
| JP | 2011173131 | A | 9/2011 |
| JP | 2014133244 | A | 7/2014 |
| JP | 2015226929 | A | 12/2015 |
| WO | 2009141244 | A1 | 11/2009 |
| WO | 2011095383 | A1 | 8/2011 |
| WO | 2017135390 | A1 | 8/2017 |

OTHER PUBLICATIONS

Office Action received in Austrian Application No. A50822/2018 dated Mar. 27, 2019, pp. 4.
Office Action received in Japanese Application No. 2021-540909 dated Aug. 1, 2022, pp. 1-10.
Office Action received in Chinese Application No. 201910911149.8 dated Apr. 25, 2022, pp. 1-29.

* cited by examiner

ROLLER STAND HAVING ELASTICALLY MOUNTED SUPPORTING ROLLERS

CROSS-REFERENCE TO RELATED APPLICATIONS

The present application is a national phase application of PCT Application No. PCT/EP2019/074940, filed Sep. 18, 2019, entitled "ROLLER STAND HAVING ELASTICALLY MOUNTED SUPPORTING ROLLERS", which claims the benefit of Austrian Patent Application No. A50822/2018, filed Sep. 25, 2018, each of which is incorporated by reference in its entirety.

BACKGROUND OF THE INVENTION

1. Field of the Invention

The invention relates to a roller stand for a billet strand casting system, having a support frame for mounting at least one lower support roller and at least two lateral support rollers, to a strand guide and a billet strand casting system, and to a method for determining the position and/or the form of a billet strand while it is passing through a billet strand casting system. The invention also relates to a signal processing device, to a machine-readable program code, and to a storage medium therefor.

2. Description of the Related Art

In billet strand casting systems, a metal strand, for example a steel strand, is guided in a strand guide in an arc from the mold via the secondary cooling chamber and the WSU—withdrawal straightening unit—to the outflow region or roller table. Support and strand guide rollers mounted in roller stands in support frames support and guide said metal strand in the process; they virtually form a strand guide channel. In the context of this application, the support and strand guide rollers are merely referred to by the term support roller below for better clarity.

In the case of insufficient lateral strand guidance of the steel strand and inadequate upper strand guidance, defects in the form of the steel strand, such as bulging, can occur. If an upper support roller is not pressed strongly enough against the steel strand, jerking—of the strand—can occur. Without lateral strand guidance, it can be difficult to ensure that the steel strand is positioned centrally and symmetrically with respect to the center line of the strand guide channel.

Irregularities in the cooling of the steel strand can lead to the billet not having the desired form. By way of example, instead of a desired rectangular cross section, a rhombic cross section can be produced.

Irregular cooling will take place, for example, if the steel strand is not positioned centrally and symmetrically with respect to the center line of the strand guide channel. In that case, the distances of cooling nozzles, which apply cooling liquid, from the steel strand will be different for different sides of the steel strand. Associated differences in the cooling intensity can lead to a form defect due to warping of the steel strand.

Form defects can also arise already in the mold on account of wear of the copper tube of the mold, or non-central positioning of the stream of molten metal or casting tube with respect to the center of the mold, or irregular cooling, for example on account of clogged cooling water channels. If necessary, the mold must be replaced. The earlier—in terms of time and location with regard to exit from the mold—the need for replacement is discovered, the more economically the billet strand can be cast.

SUMMARY OF THE INVENTION

The intention is to provide a device and a method by means of which, during billet strand casting, the risk of defects in the form of the metal strand, such as bulging or jerking or warping—for example to afford a cross section of rhombic form—can be reduced, and/or form defects can be detected at an early stage.

Said problem is solved by a roller stand for a billet strand casting system, having a support frame for mounting at least one lower support roller and at least two lateral support rollers, characterized in that the lateral support rollers are elastically mounted on the support frame by means of at least one passive elastic element which has an elasticity at least in the direction perpendicular to the axes of rotation of the lateral support rollers.

The billet strand casting system is preferably suitable for the continuous casting of a steel strand.

The metal strand is guided in an arc from the mold via the secondary cooling chamber and the WSU to the outflow region or roller table. Support and strand guide rollers mounted in roller stands in support frames support and guide the metal strand in the process; they virtually form a strand guide channel.

With regard to a metal strand, "top" in the context of this application relates to the inner arc of the metal strand, while "bottom" relates to the outer arc of the metal strand. The inner arc of the metal strand has a smaller radius than the outer arc of the metal strand. The lower support roller serves to guide and support the outer arc of the metal strand. The metal strand starts on the mold side and ends on the roller table side. As seen in the longitudinal extent of the metal strand, the metal strand has sides between the inner arc and the outer arc. The lateral support rollers serve to guide and support the metal strand on both sides. At least one lateral support roller is provided for each of the two sides of the metal strand. The support rollers are rotatably mounted about axes of rotation, with the result that they can rotate in the direction of the movement of the metal strand. The axes of rotation of the rollers preferably correspond to the longitudinal axes of the support rollers.

The support rollers support and/or guide the metal strand—preferably steel strand—during the operation of a billet strand casting system. As a result of the presence of lateral support rollers, it is possible rather to ensure a position of the steel strand that—by comparison with a process control only with lower support rollers—is central and, with respect to a reference position, such as for example the center line of the strand guide channel, symmetrical. The risk of bulging is thereby reduced, and/or bulging of the metal strand that does occur is leveled again.

In order to reduce the risk of damage to the support rollers and/or to the metal strand, the lateral support rollers are elastically mounted on the support frame. The support rollers are mounted on the support frame in an elastic manner; the support rollers are therefore mounted in such a way that their position relative to the frame can be changed, and, after a change with respect to a basic position brought about by a force, the elasticity makes it possible to return said support rollers to the basic position when the force lapses. The elasticity of the mounting exists at least in the direction perpendicular to the axis of rotation of the respective lateral support roller. The elastic mounting of the support rollers on the support frame can be direct or indirect.

A direct elastic mounting of the support rollers on the support frame is realized, for example, such that the support rollers are elastically mounted in mounting blocks fastened to the support frame. An indirect elastic mounting of the support rollers on the support frame is realized, for example, such that the support rollers are mounted in rockers, wherein the rockers are mounted on the support frame such that they can be pivoted about a pivot axis and the rockers are pivoted elastically by means of a spring between the rocker and the support frame.

Correspondingly, these support rollers can, if necessary, yield somewhat if a force exceeding a limit value is exerted on them due to a form error or non-central positioning of the metal strand. On account of the elasticity, in the absence of such a force said support rollers will return to their original position. A deflection of at least up to +/−50 mm from a basic position is preferably possible.

The elasticity of the mounting of the lateral support rollers also makes it possible to process billets having different dimensions without complex conversion work. Depending on the lateral expansion, the lateral support rollers are deflected into different positions by the metal strand and do not need to be brought into the appropriate position by conversion measures before the processing of the corresponding billet dimension starts.

According to the invention, elastic mounting is provided by means of at least one passive elastic element, preferably a spring—this applies to the at least two lateral support rollers and optionally the at least one upper support roller.

An elastic element is to be understood as meaning an element which yields reversibly under the influence of an external force. Such behavior can be achieved both by active and passive means—or combinations thereof. The elastic behavior can also be provided with a damping effect.

A passive elastic element is an element which receives its elasticity—or possibly damping effect—on account of its design and material properties, such as for example a spring or an elastomer element.

An active elastic element is an element in which the elasticity—or possibly the damping effect—can be set by open-loop or closed-loop control, as is the case, for example, for a pneumatic or hydraulic system.

According to the invention, a passive elastic element is used, not an active elastic element. By comparison with an active elastic element such as, for example, a hydraulically or pneumatically settable elastic element, this has the advantage that the devices necessary for this, such as lines, pumps, compressors, and also the maintenance thereof can be dispensed with. A passive elastic element requires comparatively less or no maintenance.

It is advantageous that the roller stand also comprises at least one upper support roller, which is elastically mounted on the support frame and has an elasticity at least in the direction perpendicular to the axis of rotation of the upper support roller. With regard to the elasticity of the mounting, the statements made above for the lateral support rollers apply.

The risk of bulging is thereby reduced, and/or bulging that does occur is leveled again.

The risk of jerking is reduced by the upper support roller, which guides and/or supports the inner arc of the metal strand. The pressure of the upper support roller prevents the strand from lifting off and prevents the strand from jerking; in this respect, the "inner bow load"—the counterpressure of the roll in the inner arc—must be suitably selected. As has already been outlined above for the lateral support rollers, the elasticity reduces the risk of damage to the support roller and/or to the metal strand. The elasticity also makes it possible to process billets having different dimensions without complex conversion work.

While, in the case of low-speed—i.e. less than 4 m/min—billet strand casting systems, upper support rollers can be dispensed with, in the case of high-speed—i.e. 4 m/min or more—billet strand casting systems, upper support rollers are preferably provided for the purpose of avoiding bulging by virtue of particularly efficient and precise support.

According to one variant, the support rollers are all arranged in a single plane. This allows a compact construction of the roller stand. The plane is preferably perpendicular to the center line of the strand guide channel.

According to a preferred variant, the lateral support rollers are all arranged in a first plane, and the lower support roller and the optionally present upper support roller are arranged in a second plane, and the first and second planes are different. The two planes therefore have an offset with respect to one another. The axes of rotation of the lateral support rollers are therefore in one plane, and the axes of rotation of the lower support roller and the optionally present upper support roller are located in another plane.

By comparison with an arrangement in a single plane, this has the advantage that it is easier to process metal strands having a large range of different dimensions because, in the case of arrangement in one plane, it is possible that elastic deflection of, for example, a pair of lateral support rollers from the upper support roller and/or the lower support roller is limited. In the case of arrangement in two different planes, an obstruction of this type is avoided.

In addition, in the case of an arrangement in two planes, the use of the same rollers as lateral support rollers and as upper and/or lower support rollers is possible in a relatively simple manner, since it is not necessary to ensure that the aforementioned limitation problems are avoided when dimensioning said rollers.

The planes are preferably perpendicular to the center line of the strand guide channel. The first and the second planes are preferably parallel. This allows a compact construction of the roller stand.

According to a preferred embodiment, the elastically mounted support rollers—i.e. the at least two lateral support rollers and optionally the at least one upper support roller—are elastically spring-loaded. That is to say, the elasticity of the mounting of said support rollers is provided by elastic springs. This allows simple manufacture and operation. By way of example, in comparison with a hydraulic elastic mounting, a complex hydraulic system can be dispensed with.

The material of the springs can be, for example, 2.4669/NiCr15Fe7TiAl; it can also be used in the demanding conditions—for example temperatures of up to 550° C.—in a billet strand casting system.

According to a preferred embodiment, in each case one support roller is provided in the roller stand per side and optionally on the upper roller arc. In comparison with roller stands having a plurality of support rollers per side, and/or optionally on the upper roller arc, such a roller stand is easier to manufacture and maintain, but provides sufficient support.

According to a preferred embodiment, the lateral support rollers, and optionally also the upper support roller, are provided with position measuring devices—for example position sensors such as differential transformers LVDT or rotary resolvers RVDT. The position measuring devices—at least one, preferably at least one per support roller, is present—are suitable for determining whether and/or to what extent support rollers are deflected from a basic position or with respect to a reference.

During operation, it can thus be determined whether and/or to what extent the support rollers are deflected from a basic position or with respect to a reference. The elastic mounting has the effect that the respective support rollers always stay in contact with the metal strand. By way of example, the lateral support rollers will be deflected to different extents if the steel strand is not positioned centrally with respect to the center line of the strand guide channel. In a similar manner, said lateral support rollers are deflected differently when the cross section of the metal strand has a rhombic form than when it has a rectangular form. Conclusions about the position of the metal strand and/or the presence of form defects can thus be made from the deflections. This makes it possible for the operator to determine whether form defects or asymmetrical positioning are present. The signals from the position measuring devices are preferably converted in a PLC (programmable logic controller) for simple display in an HMI (human machine interface).

Corrective measures can therefore be taken earlier than if form defects are discovered only on the produced billets. The closer to the mold roller stands according to the invention are installed, the earlier the need to replace the mold can be discovered. This makes it possible to configure the operation of the billet strand casting system more efficiently.

A roller block according to the invention having position measuring devices is preferably arranged in the secondary cooling chamber of the billet strand casting system. However, said roller block can also be arranged in the WSU or the outflow region at the roller table.

The present application also relates to a strand guide of a billet strand casting system which comprises at least one roller stand according to the invention. The strand guide comprises the secondary cooling chamber.

The present application also relates to a billet strand casting system which comprises at least one roller stand according to the invention or a strand guide according to the invention.

This can be, for example, in the strand guide, in the WSU or in the outflow region at the roller table.

The WSU also constitutes a support frame for mounting at least one lower support roller and at least two lateral support rollers. If elastically mounted lateral support rollers having an elasticity at least in the direction perpendicular to the axes of rotation of the lateral support rollers are present on the support frame, said WSU thus also constitutes a roller stand according to the invention.

The outflow region at the roller table has a support frame for at least one lower support roller. If the support frame is designed such that it also carries elastically mounted lateral support rollers having an elasticity at least in the direction perpendicular to the axes of rotation of the lateral support rollers, it thus also constitutes a roller stand according to the invention.

Existing roller stands can easily be replaced by roller stands according to the invention, and therefore the savings potential according to the invention can be easily achieved not only for new buildings but also for modernizations.

The present application also relates to a method for determining the position and/or the form of a billet strand while it is passing through a strand guide channel in a secondary cooling chamber and/or a WSU and/or an outflow region of a billet strand casting system, which method is characterized in that, during the passage through at least one roller stand, changes in the position of at least the lateral support rollers with respect to a reference are detected, and the position of the billet strand with respect to the center line of the strand guide channel and/or the form of the billet strand are/is determined on the basis of this information. From this, a conclusion can in turn be made that the mold needs to be replaced—it is economically advantageous not to replace the mold too early or too late—or that the cooling nozzles need to be adjusted. The method is preferably already carried out in the secondary cooling chamber of the billet strand casting system, in order to receive the information as soon as possible after leaving the mold and to be able to initiate countermeasures—for example changing the operating parameters, such as casting speed or secondary cooling parameters.

The present application also relates to a signal processing device having a machine-readable program code which includes control commands for carrying out the method according to the invention. The signal processing device is suitable for processing signals relating to detected changes in the position of at least the lateral support rollers with respect to a reference. The position of the billet strand with respect to the center line of the strand guide channel and/or the form of the billet strand can be determined by means of the signal processing device on the basis of the information from these signals.

The present application also relates to a machine-readable program code for a signal processing device, wherein the program code includes control commands which cause the signal processing device to carry out the method according to the invention.

The present application also relates to a storage medium with a machine-readable program code according to the invention which is stored thereon.

A roller stand according to the invention and/or a method according to the invention make(s) it possible for different formats to be cast more quickly, since time-consuming changes to the positions of the support rollers when changing formats can be dispensed with.

BRIEF DESCRIPTION OF THE DRAWINGS

The invention is explained with reference to schematic exemplary representations of embodiments.

DETAILED DESCRIPTION

Figure 1:
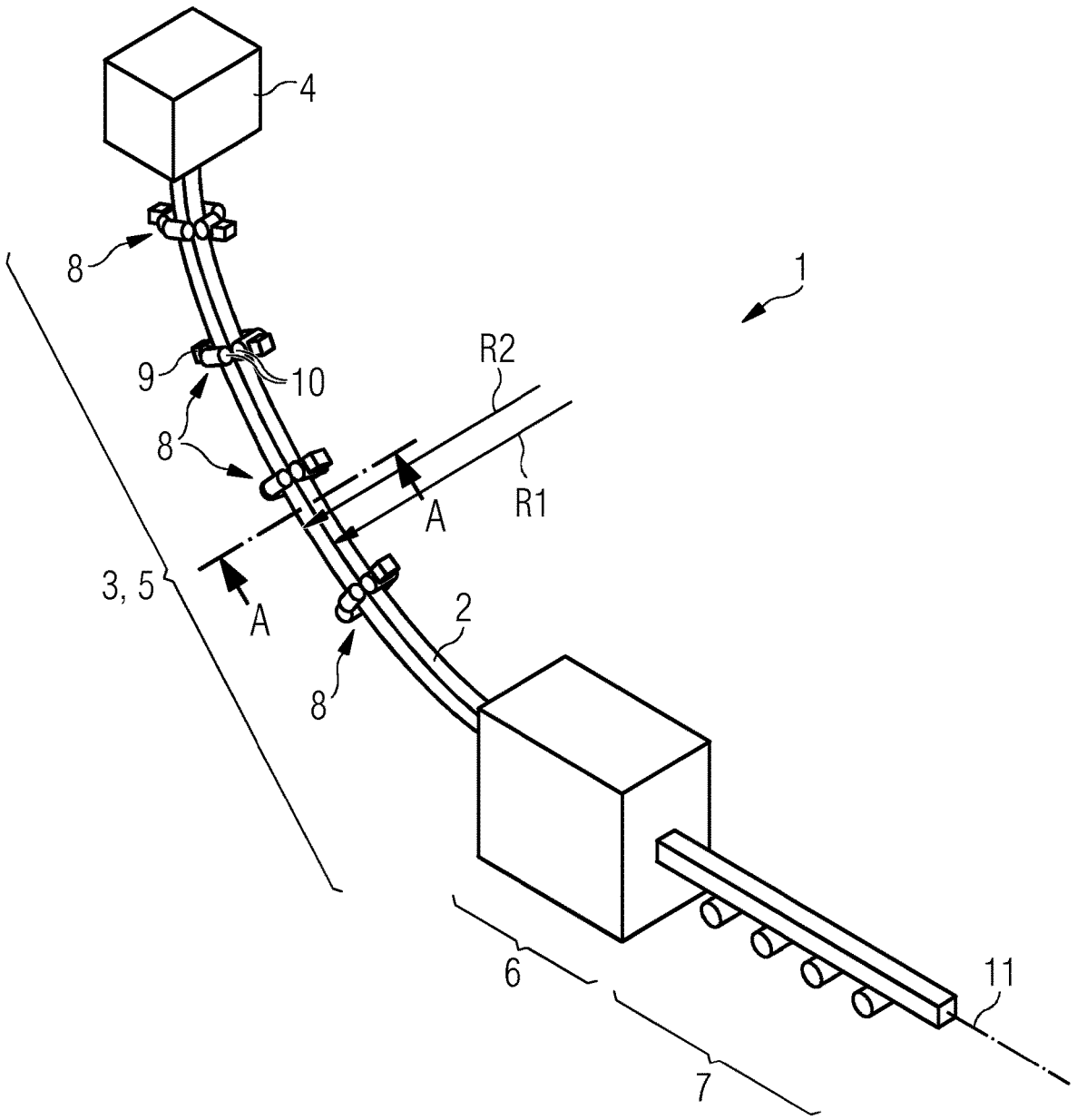
FIG. 1 schematically shows the general diagram of a billet strand casting system having conventional elements including a curved guide with support rollers for the metal strand in roller stands, on both sides as well as at the top and bottom.

FIG. 1 schematically shows an oblique view of the manner in which, in a billet strand casting system 1, a metal strand 2, for example a steel strand, is guided in a strand guide 3 in an arc from the mold 4 via the secondary cooling chamber 5 and WSU 6 to the roller table 7. Support rollers 10, which are mounted in roller stands 8 in the support frame 9, support and guide said metal strand; said support rollers virtually form a strand guide channel, the center line of which coincides with the center line of the centrally and symmetrically positioned metal strand; said center line is indicated by the dashed line 11. For better clarity, cooling bars with cooling nozzles are not illustrated. The inner arc of the metal strand has the radius R1; the outer arc has the larger radius R2.

Figure 2:
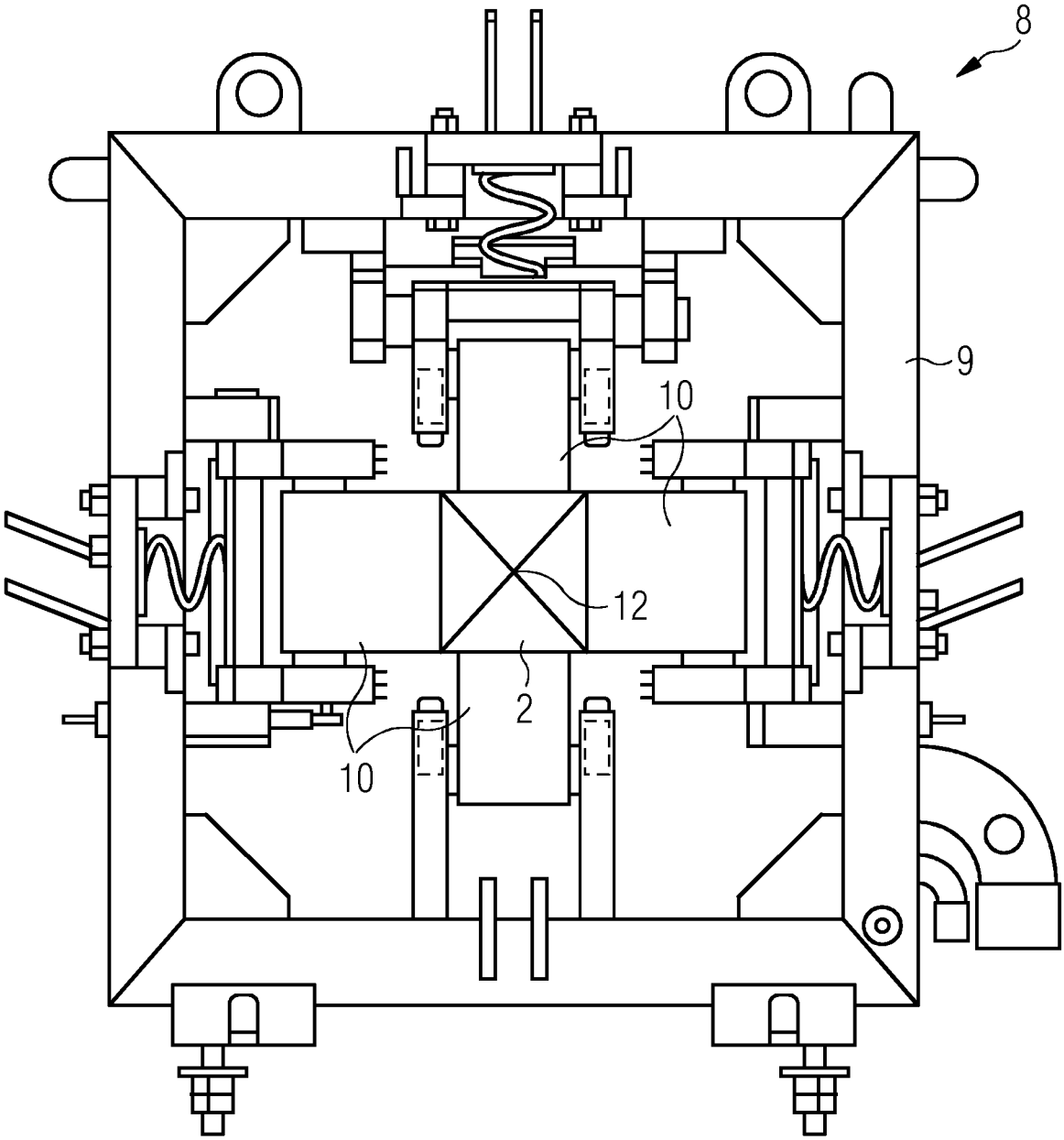
FIG. 2 shows a cross section through the strand guide channel along the broken line A-A in FIG. 1 as seen in the direction of the mold.

FIG. 2 shows a cross section through the strand guide channel along the broken line A-A from FIG. 1 as seen in the direction of the mold. The metal strand is positioned centrally and symmetrically with respect to the center of the strand guide 3, i.e. with respect to the center line of the strand guide channel. The center line of the strand guide channel is indicated by a point 12.

Figure 3:
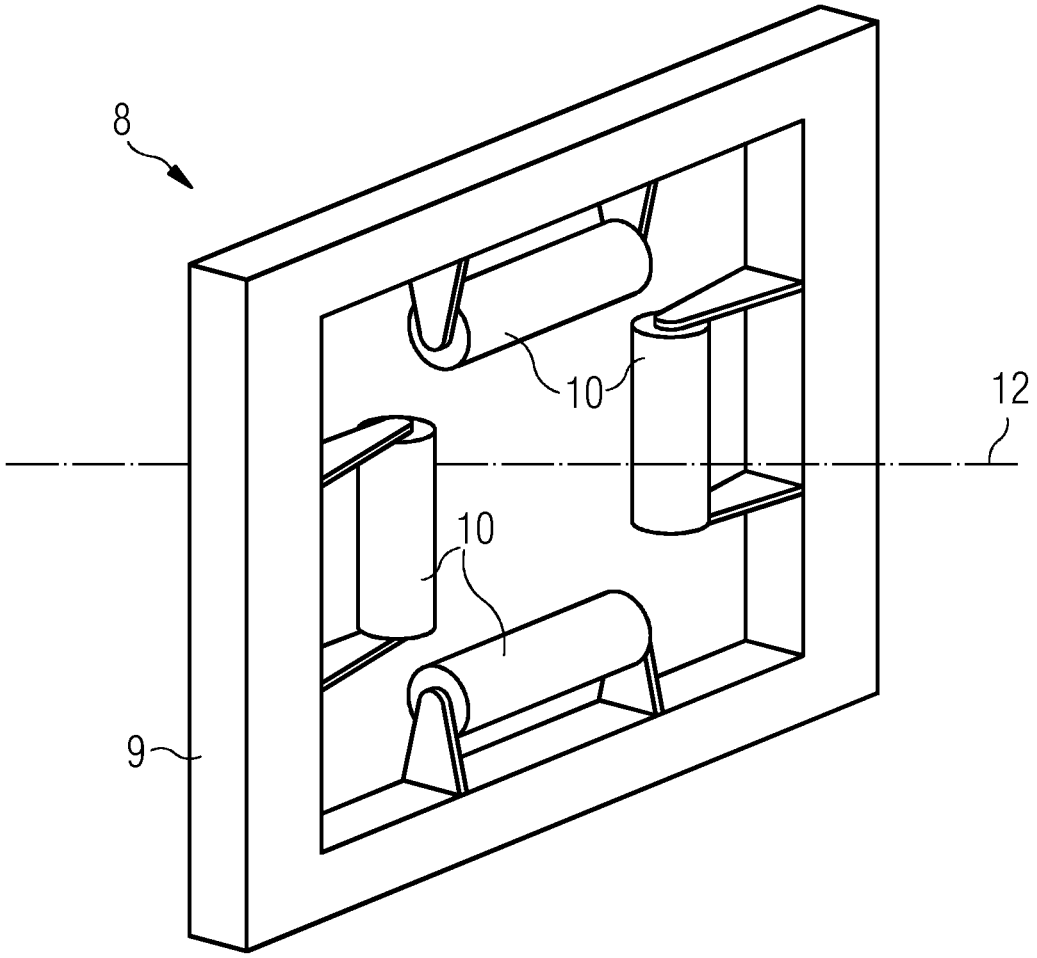
FIG. 3 shows an oblique view of a roller stand from FIG. 1.

FIG. 3 schematically shows an oblique view of a roller stand 8 having a support frame 9 and support rollers 10. The center line of the strand guide channel 12 is indicated by a dashed line.

Figure 4:
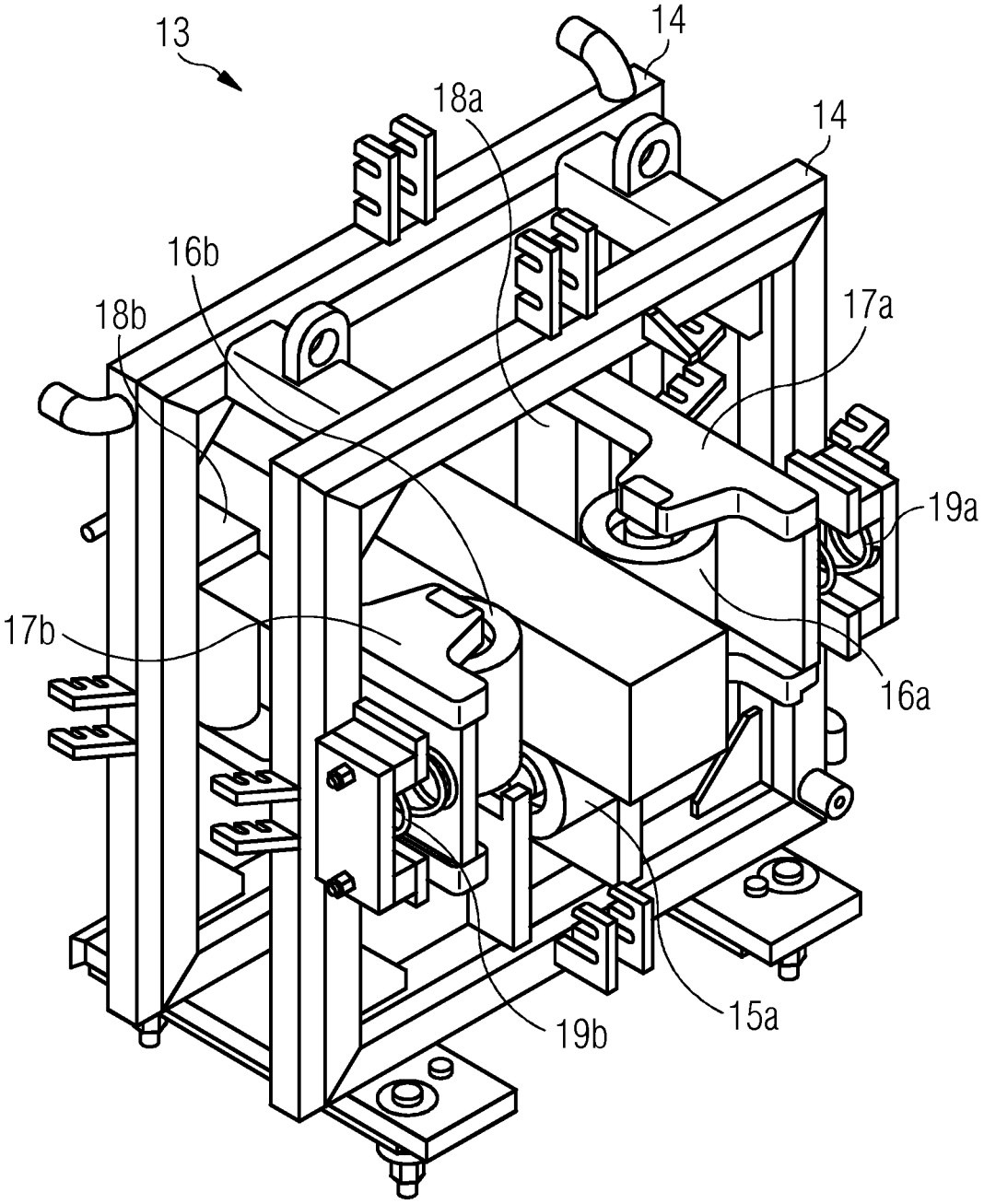
FIG. 4 shows an oblique view of a roller stand according to the invention.

FIG. 4 shows an oblique view of a roller stand 13 according to the invention. On the support frame 14, a lower support roller 15*a* and two lateral support rollers 16*a*, 16*b* are mounted and arranged in one plane. The two lateral support rollers 16*a*, 16*b* are elastically mounted on the support frame. The mounting of said support rollers has an elasticity in the direction perpendicular to the axes of rotation of said support rollers. In the case illustrated, the elastic mounting consists of rockers 17*a*, 17*b* which hold the lateral support rollers 16*a*, 16*b* and can oscillate about rocker axes 18*a*, 18*b*. The pivot axes 18*a*, 18*b* are parallel to the axes of rotation of the lateral support rollers 16*a*, 16*b*. The springs 19*a*, 19*b* provide the mounting with the elasticity perpendicular to the axes of rotation of the rollers.

Figure 5:
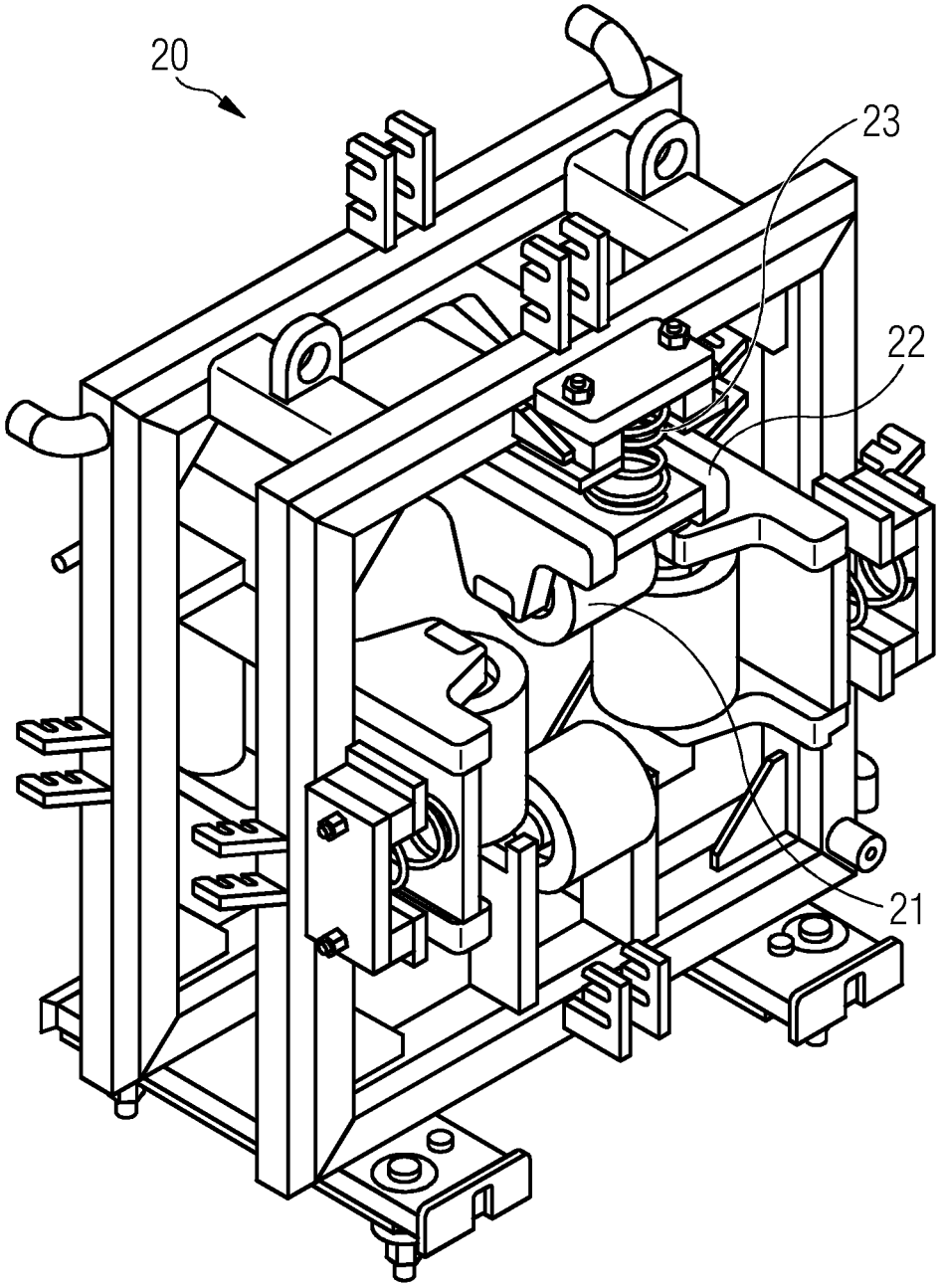
FIG. 5 shows an oblique view of another embodiment of a roller stand according to the invention.

FIG. 5 shows an oblique view of a roller stand 20 according to the invention. Parts which are analogous to FIG. 4 are not provided with reference signs for better clarity. The roller stand 20 also comprises an upper support roller 21, which is elastically mounted on the support frame and has an elasticity in the direction perpendicular to the axis of rotation of the upper support roller 21. All support rollers are arranged in one plane. In the case shown, the elastic mounting consists of the rocker 22 which holds the upper support roller 21 and can oscillate about a rocker axis parallel to the axis of rotation of the upper support roller. The spring 23 provides the mounting with the elasticity perpendicular to the axis of rotation of the roller.

Figure 6:
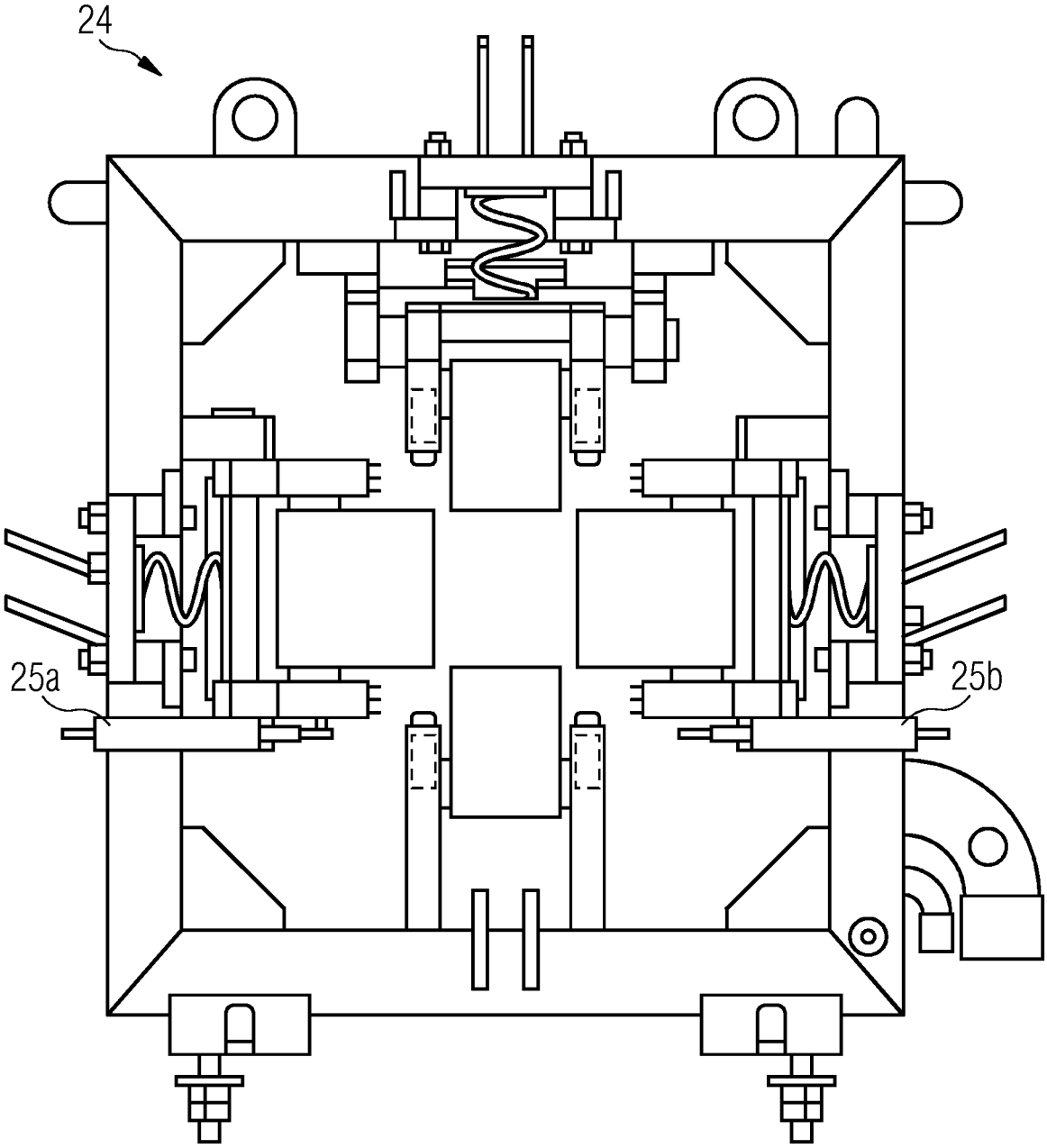
FIG. 6 shows an embodiment of a roller stand according to the invention with position measuring devices.

FIG. 6 shows a roller stand 24, largely analogous to FIG. 5, from the front. Parts which are analogous to FIG. 5 are not provided with reference signs for better clarity. The lateral support rollers are provided with position measuring devices 25*a*, 25*b*.

Figure 7A:
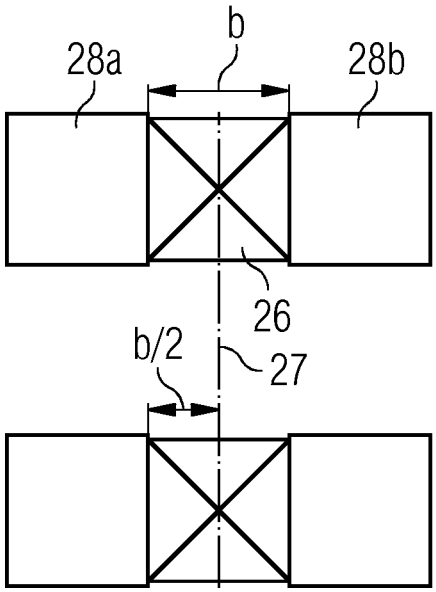
FIGS. 7*a*, 7*b*, 7*c* show the use of position measuring devices.
Figure 7B:
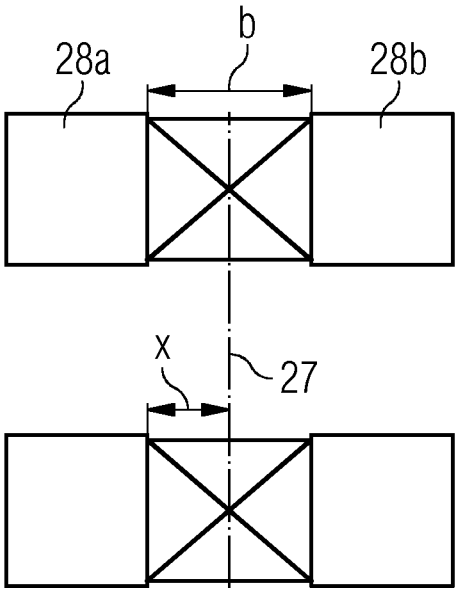
Figure 7C:
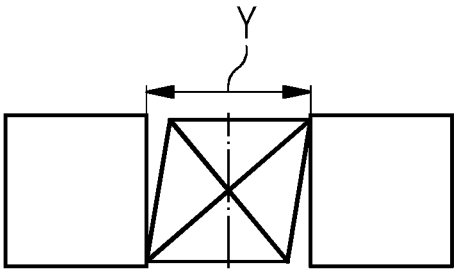

FIG. 7*a* shows a metal strand 26 of width b and without form defects which is positioned centrally and symmetrically with respect to the center of the strand guide, i.e. with respect to the center line 27 of the strand guide channel, between two lateral support rollers 28*a*, 28*b*. FIG. 7*b* shows the manner in which a metal strand of width b and without form defects is positioned asymmetrically with respect to the center of the strand guide. X is greater than b/2 of FIG. 7*a*. FIG. 7*c* shows the manner in which a metal strand is positioned centrally and symmetrically with respect to the center of the strand guide, but has a form defect. The cross section of the metal strand is rhombic, i.e. is rhomboidally warped. Y is greater than b of FIG. 7*a*. Position measuring devices can be used to measure b, X, Y. This makes it possible for the operator to determine whether form defects or asymmetrical positioning are present. The signals from the position measuring devices are preferably converted in a PLC (programmable logic controller) for simple display in an HMI (human machine interface).

Figure 8:
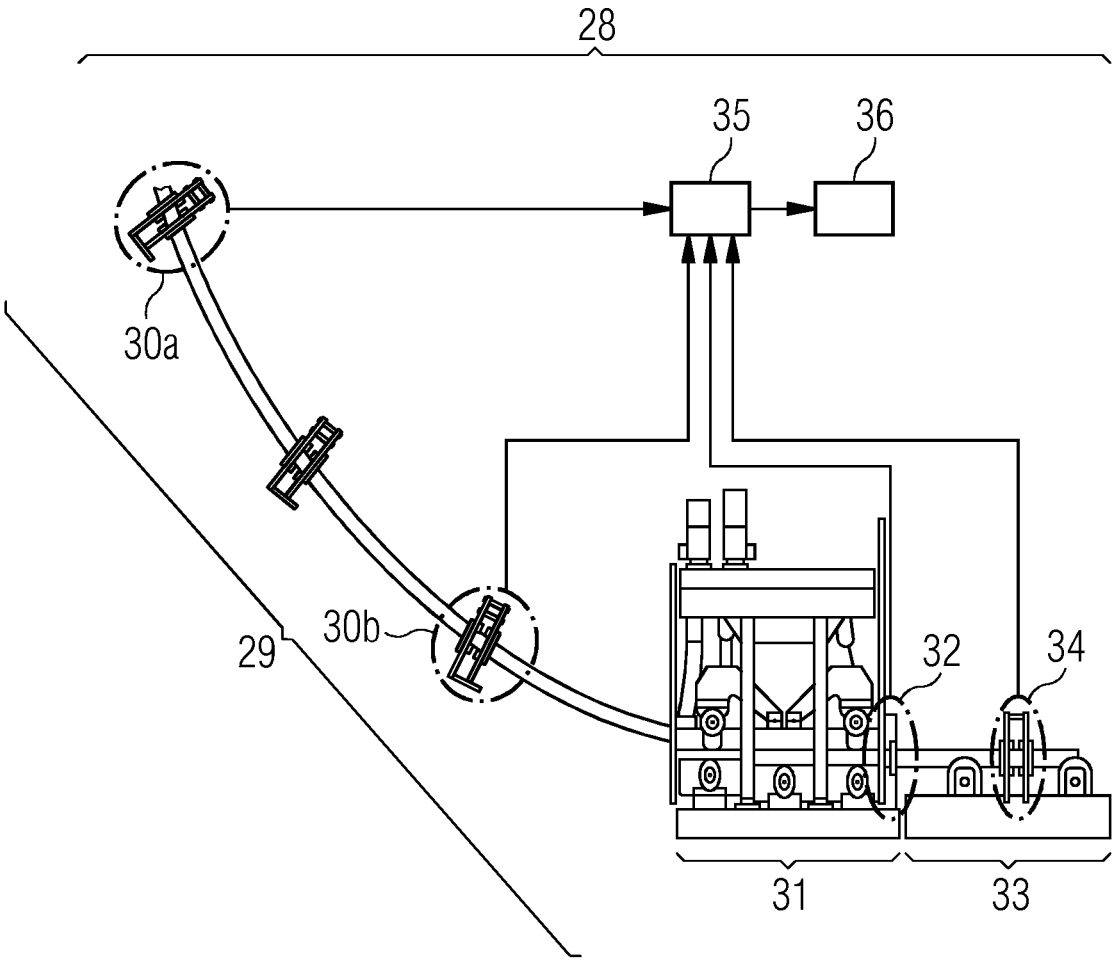
FIG. 8 shows the arrangement of roller stands according to the invention at different points of the illustrated detail of a billet strand casting system.

FIG. 8 shows the manner in which roller stands according to the invention are present at different points of a detail of a billet strand casting system 28. As illustrated, two roller stands 30*a*, 30*b* according to the invention are arranged in the secondary cooling chamber 29—there could of course in principle also be more or fewer. The roller stand 32 is present in the WSU 31. A roller stand 34 is present in the outflow region 33 of the roller table. The region with a dashed outline represents a support frame for mounting a lower support roller and two lateral support rollers. The lateral support rollers are elastically mounted on the support frame and have an elasticity at least in the direction perpendicular to the axes of rotation of the lateral support rollers. For better clarity, cutting devices have not been illustrated.

Position measuring devices, not shown in detail, on the roller stands 30*a*, 30*b*, 32, 34 are connected to a PLC 35, which in HMI 36 displays information about the positioning and form and/or form errors of the billet strand.

FIGS. 2, 4, 5, 6 schematically illustrate an indirect elastic mounting of the support rollers on the support frame in rockers, wherein the rockers are mounted on the support frame such that they can be pivoted about a pivot axis and the rockers can be pivoted elastically by a spring between the rocker and the support frame.

Although the invention has been illustrated more closely and described in detail by the preferred exemplary embodiments, the invention is not restricted by the disclosed examples and other variations can be derived therefrom by a person skilled in the art without departing from the scope of protection of the invention.

LIST OF REFERENCE SIGNS

1 Billet strand casting system
2 Metal strand
3 Strand guide
4 Mold
5 Secondary cooling chamber
6 WSU
7 Roller table
8 Roller stand
9 Support frame
10 Support rollers
11 Center line of the strand guide channel
12 Center line of the strand guide channel
13 Roller stand
14 Support frame
15*a* Lower support roller
16*a*, 16*b* Lateral support rollers
17*a*, 17*b* Rockers
18*a*, 18*b* Rocker axes
19*a*, 19*b* Springs
20 Roller stand
21 Upper support roller
22 Rocker
23 Spring
24 Roller stand
25*a*, 25*b* Position measuring devices
26 Metal strand
27 Center line of the strand guide channel

28 Billet strand casting system
29 Secondary cooling chamber
30*a*, 30*b* Roller stands
31 WSU
32 Roller stand
33 Outflow region
34 Roller stand
35 PLC
36 HMI

The invention claimed is:

1. A roller stand for a billet strand casting system, comprising:

a support frame for mounting at least one lower support roller;

at least two lateral support rollers provided with respective position measuring devices, the respective position measuring devices configured to measure a position of a respective one of the at least two lateral support rollers; and a controller configured to:

receive detected position changes of at least the lateral support rollers with respect to a reference during passage of a billet strand through a strand guide channel of the at least one roller stand, and determine, based on the detected changes, at least one of the position of the billet strand with respect to a center line of the strand guide channel and a form of the billet strand;

wherein the at least two lateral support rollers are elastically mounted on the support frame by at least one passive elastic element having an elasticity at least in a direction perpendicular to axes of rotation of the at least two lateral support rollers.

2. The roller stand as claimed in claim 1, further comprising at least one upper support roller elastically mounted on the support frame and having an elasticity at least in a direction perpendicular to an axis of rotation of the at least one upper support roller.

3. The roller stand as claimed in claim 1, wherein the at least one lower support roller and the at least two lateral support rollers are arranged in a single plane.

4. The roller stand as claimed in claim 3, further comprising:

at least one upper support roller elastically mounted on the support frame and having an elasticity at least in a direction perpendicular to an axis of rotation of the at least one upper support roller;

wherein the at least one upper support roller is provided with a further position measuring device.

5. The roller stand as claimed in claim 4, wherein the at least one upper support roller is mounted on a rocker.

6. The roller stand as claimed in claim 1, wherein:

the at least two lateral support rollers are arranged in a first plane;

the at least one lower support roller is arranged in a second plane; and the first and second planes are different.

7. The roller stand as claimed in claim 6, further comprising:

at least one upper support roller elastically mounted on the support frame and having an elasticity at least in a direction perpendicular to an axis of rotation of the at least one upper support roller;

wherein the at least one upper support roller is arranged in the second plane.

8. The roller stand as claimed in claim 6, further comprising:

at least one upper support roller elastically mounted on the support frame and having an elasticity at least in a direction perpendicular to an axis of rotation of the at least one upper support roller;

wherein the at least one upper support roller is arranged in the second plane; and wherein the at least one upper support roller is provided with a further position measuring device.

9. The roller stand as claimed in claim 1, wherein the elastically mounted support rollers are elastically spring-loaded.

10. The roller stand as claimed in claim 1, further comprising:

at least one upper support roller elastically mounted on the support frame and having an elasticity at least in a direction perpendicular to an axis of rotation of the at least one upper support roller;

wherein the at least one upper support roller is provided with a further position measuring device.

11. The roller stand as claimed in claim 1, wherein the at least one passive elastic element comprises at least one coiled spring.

12. The roller stand as claimed in claim 1, wherein the at least two lateral support rollers are mounted in rockers.

13. A strand guide of a billet strand casting system, comprising at least one roller stand as claimed in claim 1.

14. A billet strand casting system, comprising at least one roller stand as claimed in claim 1.

15. A roller stand for a billet strand casting system, comprising:

a support frame for mounting at least one lower support roller;

at least two lateral support rollers provided with respective position measuring devices;

at least one upper support roller elastically mounted on the support frame and having an elasticity at least in a direction perpendicular to an axis of rotation of the at least one upper support roller; and a controller configured to:

receive detected position changes of at least the lateral support rollers with respect to a reference during passage of a billet strand through a strand guide channel of the at least one roller stand, and determine, based on the detected changes, at least one of the position of the billet strand with respect to a center line of the strand guide channel and a form of the billet strand;

wherein the at least two lateral support rollers are elastically mounted on the support frame by at least one passive elastic element having an elasticity at least in a direction perpendicular to axes of rotation of the at least two lateral support rollers; and wherein the at least one upper support roller is provided with a further position measuring device.

16. The roller stand as claimed in claim 15, wherein the at least two lateral support rollers are mounted in rockers.

17. The roller stand as claimed in claim 15, wherein the at least one upper support roller is mounted on a rocker.

* * * * *